US012379118B2

(12) United States Patent
Dadgostar

(10) Patent No.: US 12,379,118 B2
(45) Date of Patent: Aug. 5, 2025

(54) AIR COOLER FOR BODY

(71) Applicant: Reza Dadgostar, North York (CA)

(72) Inventor: Reza Dadgostar, North York (CA)

( * ) Notice: Subject to any disclaimer, the term of this patent is extended or adjusted under 35 U.S.C. 154(b) by 155 days.

(21) Appl. No.: 18/107,984

(22) Filed: Feb. 9, 2023

(65) Prior Publication Data

US 2023/0250979 A1 Aug. 10, 2023

Related U.S. Application Data

(60) Provisional application No. 63/308,618, filed on Feb. 10, 2022.

(51) Int. Cl.
*F24F 7/06* (2006.01)
*F24F 120/00* (2018.01)

(52) U.S. Cl.
CPC ..... *F24F 7/065* (2013.01); *F24F 2120/00* (2018.01); *F24F 2221/12* (2013.01); *F24F 2221/38* (2013.01)

(58) Field of Classification Search
CPC ..... F24F 7/065; F24F 7/06; F24F 2120/00; F24F 2221/12; F24F 2221/38; A41C 3/00; A41D 13/0025
See application file for complete search history.

(56) References Cited

U.S. PATENT DOCUMENTS

2006/0174392 A1* 8/2006 Farnworth ..... A62B 17/005 2/102
2017/0246028 A1* 8/2017 Cahoon ..... A61F 7/0085

FOREIGN PATENT DOCUMENTS

CN 207370108 U * 5/2018
CN 112983870 A * 6/2021 ..... A41D 13/0025
KR 20200122792 A * 10/2020 ..... F04D 29/002
WO WO-2019077599 A1 * 4/2019

* cited by examiner

*Primary Examiner* — Emmanuel E Duke

(57) ABSTRACT

A body cooling unit which comprises a fan assembly and a pipe assembly detachably connected to each other. The fan assembly comprises a fan driven by a motor, the motor is powered by a battery. The fan, motor and battery are placed in a housing. The housing comprises inlet and outlet ports. The pipe assembly comprises at least one pipe connected to the outer port of the housing. At least one pipe comprises a plurality of openings for transferring the air to user's body.

17 Claims, 6 Drawing Sheets

AIR COOLER FOR BODY

BACKGROUND

Now a days, the working places requiring wearing of body protection suits and garments are becoming tedious and heated. People working on these conditions faces extreme heat inside the suits. Due to excessive sweat and heat in the body areas, such as chest, and back and torso are subjected to the risk of infection, which effects their working efficiency as well. Sometimes these infections may lead to severe disease in one's body.

A brassiere has become an indispensable undergarment for women's clothing. It helps in supporting women's breasts, provides cosmetic functioning by correcting any slagging or imbalances of the breasts, and facilitates in shaping women's bodies. However, due to poor air permeability and no circulation of air, the mammary glands tend to heat which may lead to sweat in these regions. In addition, it is observed that the lower portions/areas of the mammary glands tend to overheat as compared to the other regions and the sweat is even at times visible at these areas. This overheating and sweating may be very undesirable and uncomfortable for the women and may even increase the risk of skin diseases for the women.

During summers, people riding a motorcycle have to wear jackets while travelling for their protection. The jackets are warms inside and led to excessive sweating in the torso and back region. The excessive sweat can lead to itches and skin disease.

Thus, there exists a need of cooling the torso and back of a person dealing with high temperature or high heat environment.

SUMMARY

The present invention relates to a body cooling unit, for cooling the body of a person dealing with sweaty and heated environment.

In one aspect of the invention, a body cooling unit is disclosed. The body cooling unit comprises a fan assembly, a pipe assembly and a strap. The body cooling unit is weared around the chest of a person.

In another aspect of the invention, a brassier accommodating the body cooling unit is disclosed. The brassier comprises a pipe receiving opening provided below the first and second bra cups. The pipe of the body cooling unit is inserted into the pipe receiving opening.

In another aspect of the invention, a jacket accommodating the body cooling unit is disclosed. The jacket comprises a series of pipe channels interconnected inside the jacket. A pipe connector is provided inside the pocket of jacket, to connect to fan assembly.

DESCRIPTION

The following thorough description is intended to serve as a description of exemplary embodiments in which the currently disclosed subject matter may be practised in combination with the appended drawings. When the word "exemplary" is used in this description, it implies "serving as an example, instance, or illustration," and it shouldn't necessarily be used to suggest that one embodiment is better than another. The detailed include some specific details that help in fully understand the currently disclosed body cooling mechanism. However, it will be apparent to those skilled in the art that the presently disclosed subject matter may be practiced without these specific details. In order to avoid confusing the concepts of the disclosed body cooling system, it may be necessary to display well-known structures and devices in functional or conceptual schematic form.

In the present specification, an embodiment showing a singular component should not be considered limiting. Rather, the subject matter preferably encompasses other embodiments including a plurality of the same component, and vice-versa, unless explicitly stated otherwise herein. Furthermore, unless expressly stated otherwise, the applicant does not intend for any phrase in the specification to be given a peculiar or special interpretation. Additionally, the current subject matter includes current and future counterparts to the known components used here as examples.

Although the present subject matter describes a body cooling unit, it is to be further understood that numerous-changes may arise in the details of the embodiments of body cooling unit. It is contemplated that all such changes and additional embodiments are within the spirit and true scope of this disclosure.

Figure 1:
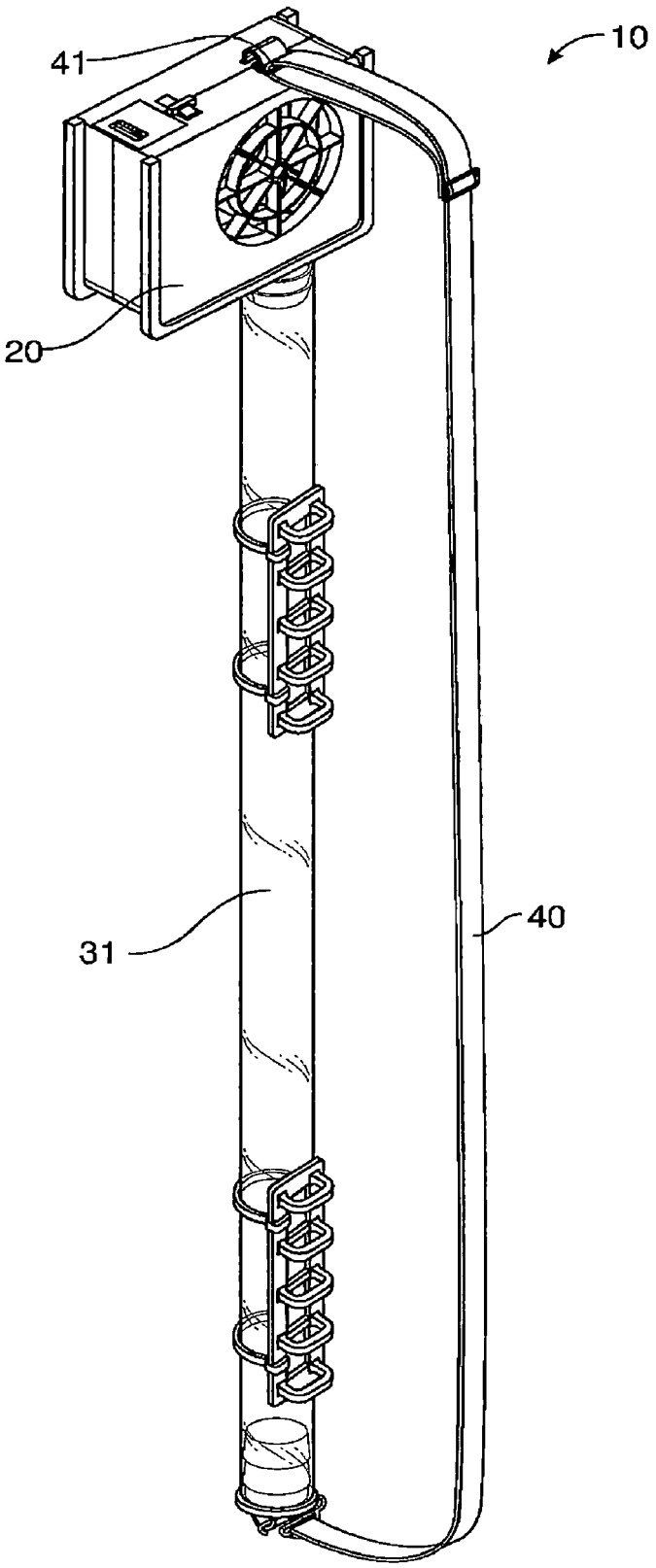
FIG. 1 illustrate a body cooling unit, in accordance with an embodiment of the disclosure.

Referring to FIG. 1, the invention shows a body cooling unit 10. The body cooling unit 10 comprises at least one fan assembly 20, at least one pipe assembly 30 and a strap 40. The pipe assembly 30 has two ends. The fan assembly 20 can be installed and removed from the pipe assembly 30 from both ends according to the will of the user.

Figure 2:
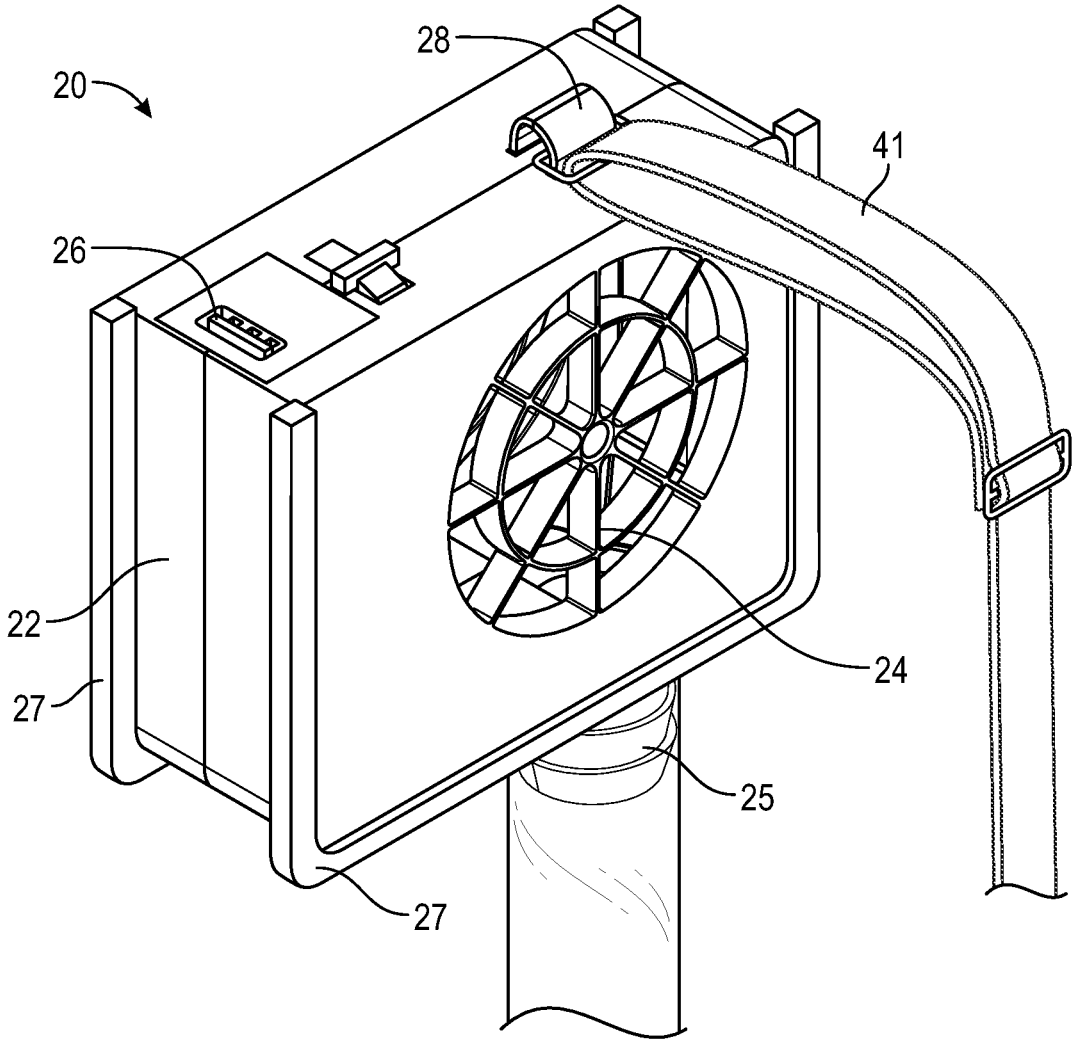
FIG. 2 illustrates a fan assembly of the body cooling unit, in accordance with an embodiment of the disclosure.

Referring to FIG. 2 the fan assembly 20 comprises a fan (not shown) firmly held inside a fan housing 22. The fan used can be a radial fan or an axial fan. The fan is driven by an electric motor (not shown). The electric motor is driven by a rechargeable Li-ion battery placed inside the housing 22. The battery is replaceable and can be removed if there is a major issue in the battery. The housing 22 further comprises a switch (not shown), positioned on outer surface of the housing 22, to turn on/off the fan. The housing is provided with a recharging port 26 to charge the battery.

The housing 22 further comprises air inlet port 24 for sucking the air and air outlet port 25 for transferring the sucked air to pipe assembly 30. An air filter (not shown) can be attached in front of the air inlet 24 to prevent the dust from entering the pipe assembly 30. The pipe assembly 30 comprises at least one pipe 31 connected to air outlet port 25.

Figure 3:
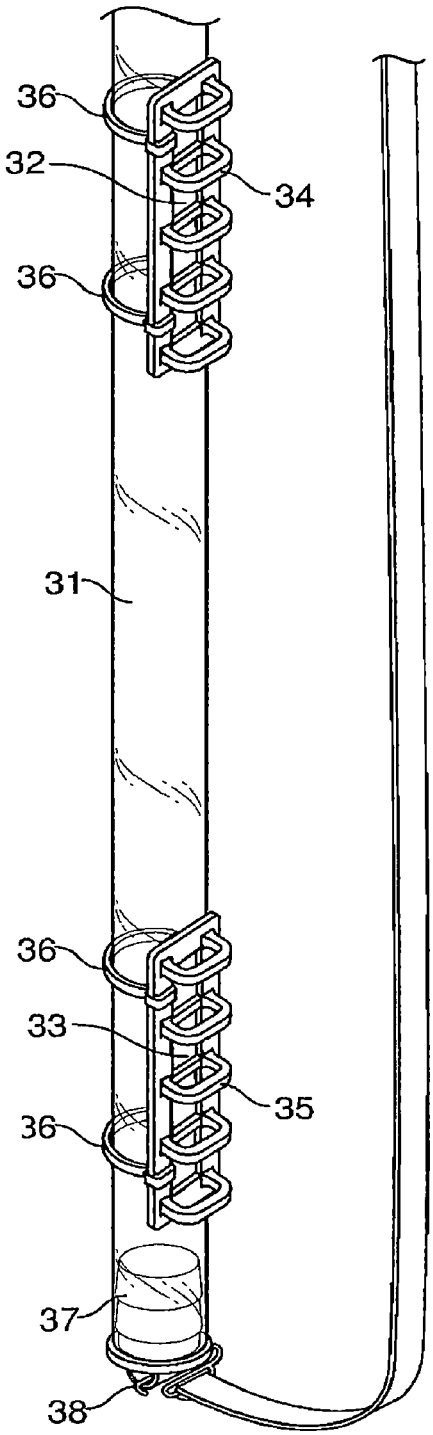
FIG. 3 illustrates a pipe assembly of the body cooling unit, in accordance with an embodiment of the disclosure.

Referring to FIG. 3, the pipe 31 comprises a plurality of openings 32, 33 (not shown) along the air delivery path. The length and width of the pipe openings are approximately the same size as the air guide connectors 34, 35. The openings 32, 33 are covered with air guide connectors 34, 35 for guiding the air flow in a particular direction. The connectors 34, 35 are held on to the pipe 31 in position by a plurality of retaining clips 36. The connectors 34, 35 have similar design and operation. The connectors 34, 35 can be arranged in multiple positions along the pipe 31 and in both direction to guide the air on upper part and lower part of the body.

Figure 4:
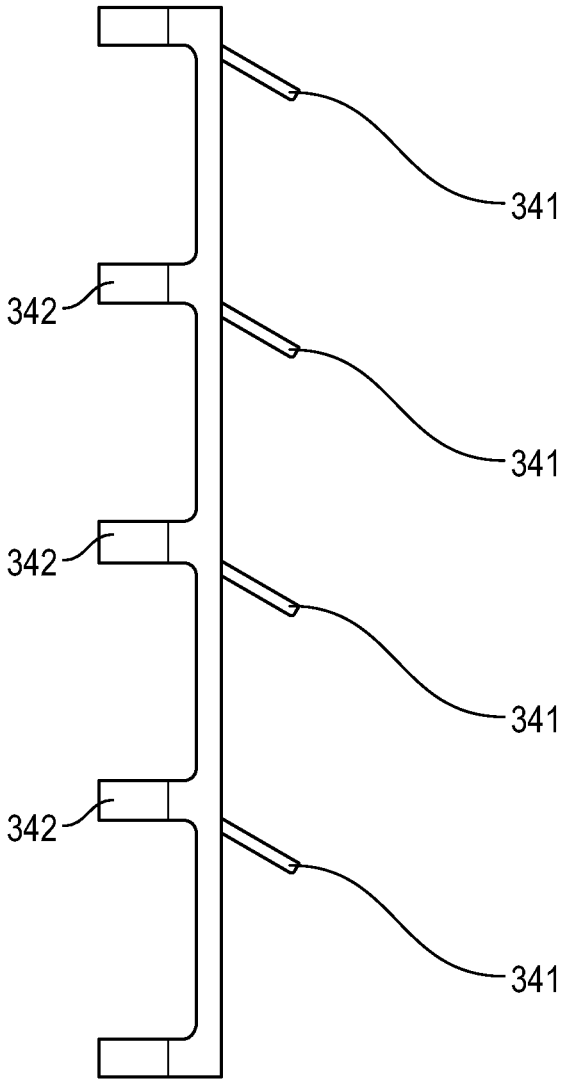
FIG. 4 illustrates the connector portions, a schematic of pipe assembly of FIG. 3; in accordance with an embodiment of the disclosure.

As shown in FIG. 4, the connectors 34 comprises a plurality of air flow receiving vanes 341, placed in air flow channel to receive the air and guide it towards body of the person with the help of guide bars 342 arranged on the opposite side of the air flow receiving vanes 341. Guide bars used as spacers for providing gap between the openings in connector 34,35 and human skin, such that the air flows over the skin. Also, guide bars 342 are used to prevent clogging and direct air flow from air flow receiving vanes 341 to human skin.

In one embodiment of the invention, the connector 34 is located near of the outlet port 25 and connector 35 is located at far from the outlet port 25. The air flow guide flaps of connector 35 should be bigger than air flow guide flaps of the connector 34, to receive more air when air is passing through the air channel. As connector 34 is present near the outlet port 25, the flow of air is higher as compared to the flow of air near the connector 35. Thus, air guide flaps of connector 34 could be of smaller size, so that appropriate amount of air is transfer to the connector 35.

Referring back to FIG. 3, the pipe 31 is provided with a stop plug 37, to prevent air from leaking from other end of the pipe 31.

The body cooling unit 10 defines an air channel which extends from outlet port 25 of the fan assembly 20 and till the plug 37 of the pipe assembly. The air channel comprises plurality of openings connected to connectors for supplying the cooling air to the body parts of the person.

Referring back to FIG. 1, the strap 40 comprises two ends 41 and 42 that are detachable. The strap 40 is made from a flexible material and can be extended in the length when pulled.

Referring again to FIG. 2, the housing 22, further comprises foamed edges 27 provided on the external surface of the housing 22, for the ease of the person wearing the device.

Figure 5:
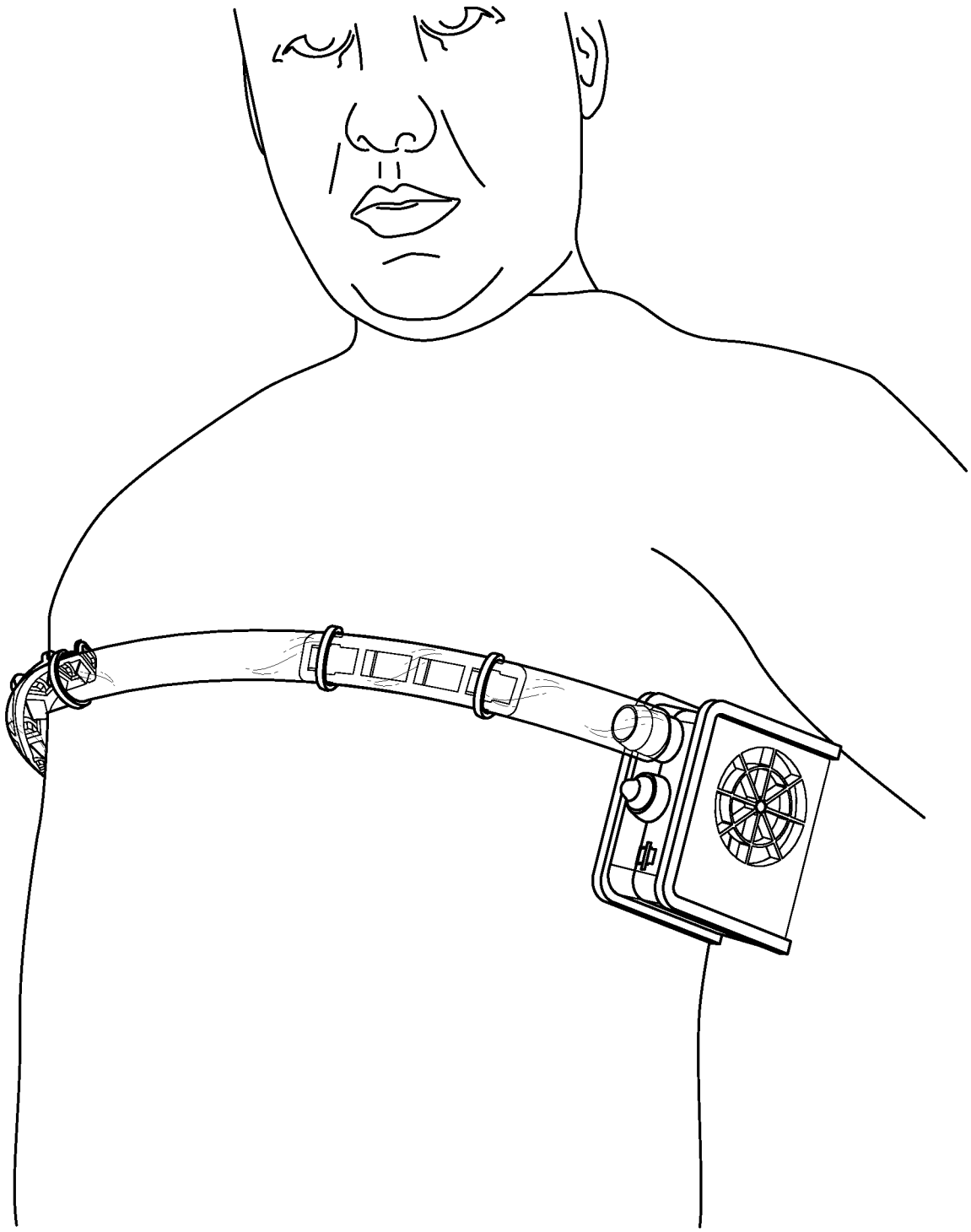
FIG. 5, illustrates a person wearing the body cooling unit; in accordance with an embodiment of the disclosure.

Referring to FIG. 1, FIG. 3 and FIG. 5, the working principle of the body cooling unit 10 is explained. The person working in the heated environment can hold the body cooling unit near the body area where the body cooling is required. First end 41 of the strap 40 is connected to the connecting element 28 provided on the fan housing 22. The second end of the housing is connected to connecting element 38 provided on the stop plug 37 of the pipe assembly 30. Thus the whole unit can be worn as a single unit.

Figure 6:
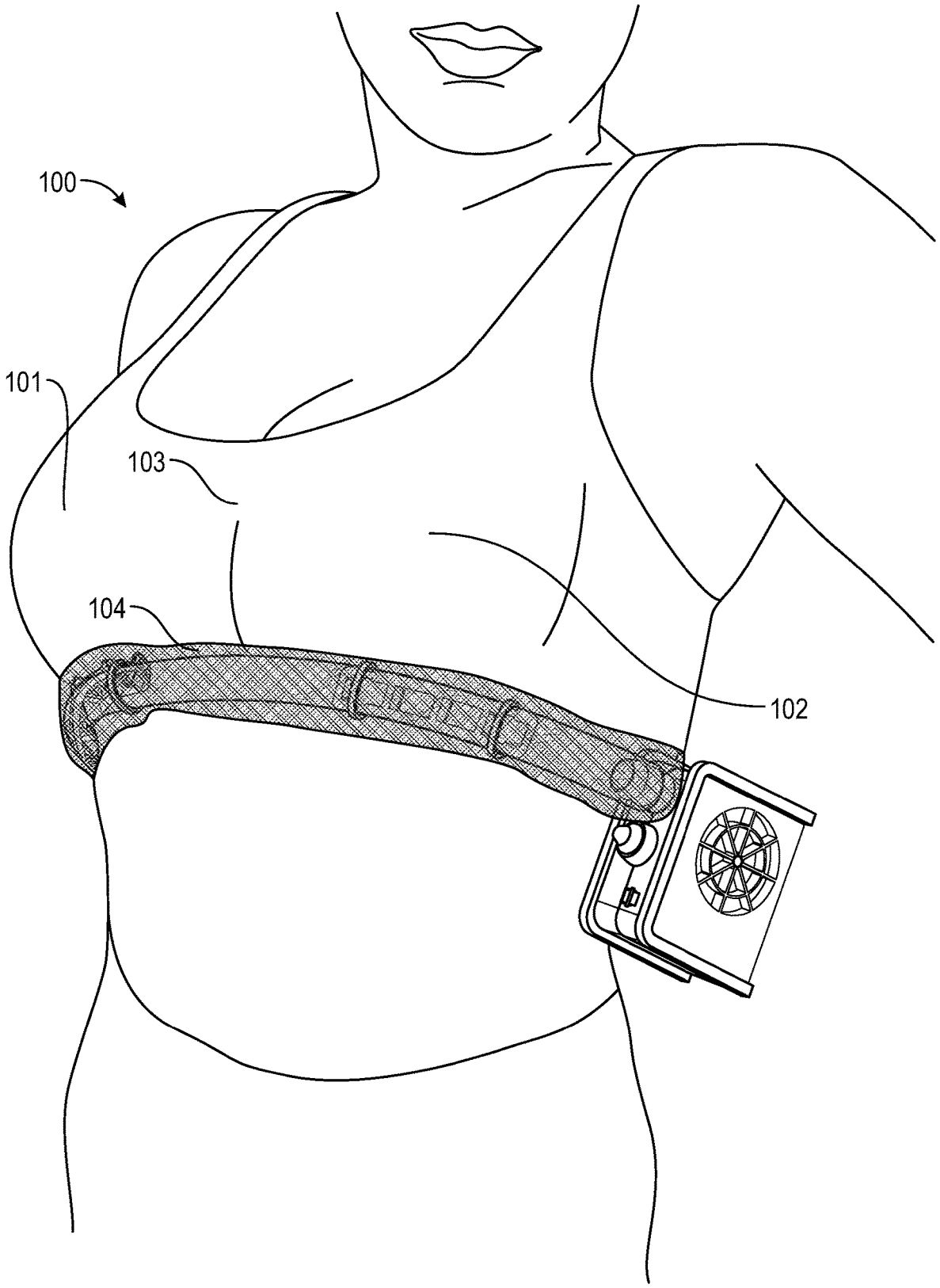
FIG. 6 illustrates a person wearing a brassier with the body cooling unit; in accordance with another embodiment of the disclosure.

According to another embodiment of the invention, the air cooling unit 10 can be installed in women's garments such as brassier. Referring to FIG. 6, a brassiere 100 adapted to be worn by women is shown. As shown the brassier includes a body structure which defines a shape of the brassiere. The body structure includes a front portion having a pair of bra cups, for example, a first bra cup 101 and a second bra cup 102, and a centre gore 103 disposed between the first bra cup 101 and the second bra cup 102 and connecting the first bra cup 101 and the second bra cup 102. The front portion also includes a pipe receiving portion 104 arranged underneath the first bra cup 101 and the second bra cup 102. The brassier further includes a back portion (not shown) and a pair of straps. It may be contemplated that the pair of straps support the brassiere on shoulders of the wearer.

Referring to FIG. 6, a schematic of the brassier having a cooling unit is shown. The pipe 31 can be permanently inserted in the pipe receiving portion 104 of the brassier. When required, the fan assembly 20 can be connected to the pipe assembly 30. The fan 21 can be turned on by pressing the switch (not shown).

According to another embodiment of the invention, the air cooling unit 10 can be installed in a jacket of a person. The internal structure of the jacket can be provided with a plurality of pipe channels interconnected with each other. The pipe channels are provided with plurality of opening near the region of the body that requires more cooling. Connection ports for connecting two or more fan assembly 20 and pipe assembly 30 can be provided in the pocket of the jacket.

According to the above mentioned embodiments, the body cooling unit 10 comprises a controller (not shown). The controller can be used to control the working of fan automatically. The women's brassier and the jacket mentioned in the above embodiments, can be accommodated with a temperature sensor. The temperature sensor share the feedback of the body temperature with the controller. If a threshold body temperature is detected by the temperature sensor, the controller turns on the body cooling unit.

In another embodiment, the controller is capable of wireless communication. The controller can be wirelessly connected to a handheld device such as smartphone, PDA, etc. Thus the body control unit can also be controlled by handheld device. The threshold temperature of the temperature sensor can be adjusted by the handheld device. In another example, the handheld device can preset a duration of time for which the body cooling unit can operates. The controller can also be used to detect the battery percentage, and indicates remaining battery life on the handheld device. A charging notification can be shown on the display of handheld device if the remaining battery life is low.

In another embodiment, the body cooling unit 10 can also comprises a heartbeat detection sensor (not shown), for measuring the heartbeat of the person working in the heated environment. The heartbeat sensor is connected to the controller. If the heartbeat of the person falls below a minimum threshold, an emergency situation can be notified through the handheld device for notifying the doctors and close relatives of the user. In another embodiments, if the person is wearing the body cooling unit, in case of panic attacks, the body precipitates higher than normal conditions, and the heartbeat of the person also increases. Thus, the controller can automatically switch on/off the body cooling unit based on feedback from heartbeat detection sensor.

In another embodiment, a location detection unit can be installed in the body cooling unit. When a person is wearing a suit and he enters a region where the application requirement are of high temperature, such as based on a floor plan of an industry using high temperature furnaces, the controller can detect the location of the person and accordingly turns on the body cooling unit.

Thus, various modifications of these disclosed embodiments are apparent to those skilled in the art, from the description and the accompanying drawing. The principle associated with the various embodiments described herein may be applied to the other embodiments. Therefore, the description is not intended to be limited to the embodiments shown along with the accompanying drawings but is to be providing the broadest scope of consistency with the principles and the novel and inventive features disclosed or suggested herein. Accordingly, the invention is anticipated to hold on to other alternatives, modifications, and variations that fall within the scope of the present invention and appended claims.

The invention claimed is:

1. A body cooling unit, comprising, at least one fan assembly comprising at least a fan driven by a motor placed in a housing;

the housing comprises inlet port and outlet port, at least one pipe assembly comprising at least one pipe connected to the outlet port, wherein, at least one pipe comprises a plurality of openings;

the plurality of openings are in communication with flow guide vanes provided on at least one pipe, for guiding the air flow towards human body.

2. The body cooling unit of claim 1, the fan assembly and the pipe assembly are detachable.

3. The body cooling unit of claim 2, the fan assembly can be attached from both sides of the pipe assembly.

4. The body cooling unit of claim 1, comprises a flexible strap to be connected the body cooling unit, the strap is configured to worn around the body.

5. The body cooling unit of claim 1, further comprising a filter for preventing dust from entering the air channel.

6. The pipe assembly of claim 1, further comprises first and second connectors, arranged on the openings provided on the pipe.

7. The connectors of claim 6 comprises air flow guide vanes, where the guide vanes of the second connector are greater in size than the guide vanes of the first connector, for accommodating more air in low pressure area.

8. The body cooling unit of claim 1, further comprises a controller for automated working of the body cooling unit.

9. The controller of the claim 8, further comprises a temperature sensor for measuring the temperature of user's body.

10. The controller of claim 8, further comprises a heartbeat detection sensor for monitoring the state of the person, and switching on/off the body cooling unit automatically based on feedback from the heartbeat detection sensor.

11. The body cooling unit of claim 1, further can be wirelessly connected to a handheld device for it remote operations.

12. A brassiere, comprising:

a body structure including a front portion having two bra cups; and a body cooling unit mounted to the body structure, below the bra-cups and adapted to provide a cooling air to one or more regions of the breasts of a wearer, the cooling unit includes;

a fan assembly to generate a flow of air, and a pipe assembly comprising at least one pipe connected to the fan assembly and extending below the peripheries of the bra cups, the at least one conduit defines a plurality of holes to discharge the cooling air from the at least one conduit towards the one or more regions of the breasts of the wearer.

13. The brassier of claim 12, the fan assembly and the pipe assembly are detachable from one another.

14. The brassier of claim 12, a filter is connected to the inlet port of the fan assembly housing to prevent dust from entering the air channel.

15. The brassier of claim 12, further comprises a controller for automated working of the body cooling unit.

16. The controller of the claim 12, further comprises a temperature sensor for measuring the temperature of user's body.

17. The brassier of claim 12, further can be wirelessly connected to a handheld device for it remote operations.

* * * * *